US006378822B1

(12) United States Patent
Franks

(10) Patent No.: US 6,378,822 B1
(45) Date of Patent: Apr. 30, 2002

(54) STEP ASSEMBLY FOR HOLLOW POLES AND THE LIKE

(75) Inventor: George J. Franks, Inverness, IL (US)

(73) Assignee: Senior Industries, Inc., Wood Dale, IL (US)

( * ) Notice: Subject to any disclaimer, the term of this patent is extended or adjusted under 35 U.S.C. 154(b) by 0 days.

(21) Appl. No.: 09/757,296

(22) Filed: Jan. 9, 2001

(51) Int. Cl.[7] ..... E06C 9/00
(52) U.S. Cl. ..... 248/218.4; 182/92; 182/90
(58) Field of Search ..... 248/222.51, 218.4, 248/231.9, 231.91, 500, 507, 503, 505, 508; 411/340, 345, 346; 182/92, 90

(56) References Cited

U.S. PATENT DOCUMENTS

| | | | | | |
|---|---|---|---|---|---|
| 459,844 | A | * | 9/1891 | Thomas | 144/287 |
| 471,626 | A | * | 3/1892 | Streeter | 182/189 |
| 614,177 | A | * | 11/1898 | McBride | 182/92 |
| 1,322,869 | A | * | 11/1919 | Benedict | 182/92 |
| 1,588,566 | A | * | 6/1926 | Wismer | 144/307 |
| 1,630,293 | A | * | 5/1927 | Fish | 182/92 |
| 1,740,873 | A | * | 12/1929 | Peirce | |
| 2,957,538 | A | * | 10/1960 | Pottmeyer | 182/189 |
| 3,835,958 | A | * | 9/1974 | Hegele | 182/189 |
| 4,402,385 | A | * | 9/1983 | Buche | 182/91 |
| 4,620,610 | A | * | 11/1986 | Southard | 182/228.1 |
| 4,697,669 | A | * | 10/1987 | Bergsten | 182/189 |
| 4,867,272 | A | * | 9/1989 | Troubridge | 182/189 |
| 4,901,965 | A | * | 2/1990 | Bowman | 108/108 |
| 5,279,388 | A | * | 1/1994 | Laughlin et al. | 182/90 |
| 5,544,717 | A | * | 8/1996 | White et al. | 182/90 |
| 5,761,875 | A | | 6/1998 | Oliphant et al. | 52/721.2 |
| 5,941,485 | A | | 8/1999 | Davidson et al. | 248/218.4 |
| 5,944,139 | A | * | 8/1999 | Kozial | 182/90 |

OTHER PUBLICATIONS

Lindsey brochure showing fiberglass pole steps, totaling 7 pages, which brochure has been available for more than one year prior to the filing date of the present application.

* cited by examiner

*Primary Examiner*—Leslie A. Braun
*Assistant Examiner*—Ingrid Weinhold
(74) *Attorney, Agent, or Firm*—Fitch, Even, Tabin & Flannery

(57) ABSTRACT

A step assembly for securing a step to hollow poles and like. The step assembly includes a lock bushing and a mounting base that have cooperating flats to prevent relative rotational movement between the pole-like structure and the step. More particularly, the step includes a first end portion with an arm and a flat. The first end portion extends through a hole in the pole-like structure to position the arm in the pole-like structure. The lock bushing also includes a flat that defines, in part, an interior hole that receives the first end portion of the step so that the flat can engage the flat on the step. The lock bushing also includes an exterior flat and can be received by a hole defined by the base such that a flat surface or edge on the base engages the exterior flat on the lock bushing. The flats prevent relative rotational motion between the pole-like structure and the step. The base also includes an arcuate surface that engage the pole-like structure to prevent relative rotational movement between the base and pole-like structure. A clamp on the step is tightened to clamp the lock bushing, the base and the arm to the pole-like structure to prevent radial movement of such components relative to the pole. The step also includes a second end portion that includes a stop such that the stop and arm of the first end portion sufficiently captivate the components of the step assembly on the step to facility efficient and effective installation.

11 Claims, 3 Drawing Sheets

12
16
10
14
18
20
22
24
26
28
32
34
36
42
44
46
48
49
50
52
54
56
58
60
62
64
76
4
5
6

STEP ASSEMBLY FOR HOLLOW POLES AND THE LIKE

FIELD OF THE INVENTION

The present invention relates generally to steps for climbing hollow poles, such as utility poles, and similar structures and, more particularly, to a step assembly that readily attaches and detaches a step to and from such structures.

BACKGROUND OF THE INVENTION

Elongated poles are commonly used to maintain items above and over the ground for numerous reasons, including safety and ground space conservation purposes. The utility industry, for example, uses many poles to support cables and other components of the utility's system. These poles are often hollow and made of steel and/or fiberglass. These poles are typically fitted with steps that extend radially from the pole in a cantilever fashion to enable utility personnel to climb the pole to perform maintenance operations on the equipment. The specific structures of these pole steps vary.

For example, one known pole step is disclosed in U.S. Pat. No. 5,941,485 to Davidson et al. This pole step includes a mounting subassembly and a separate step. A shortcoming with this design is the potential for the step to become unintentionally detached from the pole. For example, the step is mounted using a vertical slot which slides over the head of a mounting bolt and a washer at the head. Other then the clamping pressure of the bolt, the step is not locked against rotational and upward movement, especially if the bolt is not tightened adequately or becomes loosened from use. Further, when the climber accidentally hits the bottom of the step with his or her foot, there is potential for the step to loosen and unintentionally disengage from the mounting subassembly.

Another known utility pole step is one that uses a mounting plate, a washer and a nut to attach an elongated step in a cantilever fashion to the pole. The elongated step includes an arm portion at one end that is bent 90-degrees with respect to the rest of the step. The step extends through the bore into the utility pole to position the arm in the pole to engage the inner wall of the pole. A portion of the step material at the bend creating the arm is pinched to create a projection. The step also extends through a hole in the mounting plate at the exterior of the pole. The bottom of the hole in the mounting plate includes a tab angled away from the plate into the hole to engage the pinched projection of the step bend to prevent the step from being rotated as the nut and lock washer are being tightened on a threaded portion of the step to secure the step.

A shortcoming of this design is its failure to ensure that the step cannot rotate about its longitudinal axis upon torque created by a user's foot rubbing across the step. The projection engagement only limits rotation in one direction. Further, upon enough rotation in the direction away from the bend projection, the arm has the potential to face sideways or even downward which may result in the step becoming loose and even detached from the pole. Another shortcoming includes the potential weakening of the step caused by the pinching of the material at the bend, requiring strength to support the step in the cantilevered fashion from the pole. A shortcoming to both the foregoing designs is that the components are not part of a common assembly by sufficiently captivating the components to facilitate effective and efficient installation, especially as one is climbing the pole. For example, the Davidson design has two separate parts requiring separate installations. The mounting subassembly must first be attached to the pole in order to later attach the step. With the other design, the components, such as the mounting plate, can easily come off the elongated step. It is common for a climber to have to install the steps as he or she climbs the pole because the lower portion of the pole has the steps removed to prevent unauthorized climbing of the pole. Thus, this design is problematic especially when the climber is installing the steps as he or she climbs the pole because, not only does the climber have to be concerned with properly tightening the assembly, with a tool, he or she has to deal with the multiple components and their easy potential to become separated from the assembly.

Thus, there remains a need for a pole step assembly that secures the step against unintentional rotational movement and that facilitates efficient and effective installation to the pole.

SUMMARY OF THE INVENTION

The present invention pertains to a step assembly that is capable of securing to a hollow pole having at least one hole for mounting purposes. The step assembly includes an elongated step with a first end portion and a second end portion opposite the first end portion. The first end portion has an arm and at least one flat. The first end portion is capable of extending through a hole to position the arm inside the hollow pole.

The step assembly also includes a bushing on the step. The bushing defines an interior hole with at least one interior flat for engaging the flat of the first end portion to prevent relative rotational movement between the step and the bushing. The bushing also includes at least one exterior flat.

The step assembly further includes a base on the step. The base includes a surface for engaging the hollow pole to prevent relative rotational movement between the hollow pole and the base. The base also includes an edge defining a hole for receiving the bushing and for engaging the exterior flat of the bushing to prevent relative rotational movement between the bushing and the base.

The step assembly further includes a clamp along the step. The clamp has surfaces that engage the step at various predetermined positions to prevent longitudinal movement of the bushing and base along the step.

The second end portion of the step may include a stop such that the stop and the arm of the first end portion are of sufficient size and configuration to sufficiently captivate the bushing, the base and the clamp on the step to facilitate securing of the step assembly to the hollow pole. The base may include one sidewall, which includes the surface engaging the hollow pole. The sidewall also spaces the edge defining the hole of the base from the hollow pole. The surface engaging the hollow pole may have an arcuate profile to complement an arcuate exterior profile of the hollow hole.

The first end portion of the step may have at least four flats. The interior hole of the bushing may be defined, at least in part, by at least four flats. Thus, the four flats of the step would engage the four flats of the bushing to prevent relative rotational movement between the step and the bushing. The first end portion may further have a square cross-section forming at least four flats of the step. The interior hole of the bushing also may have a complementary square cross-section defined by the at least four flats of the bushing.

At lease some portion of the first end portion of the step may have a larger transverse cross-section than that for the remainder of the step. The bushing and the base may encircle the step. The bushing and the base also may be permanently affixed to one another or, alternatively, may be formed to constitute a single component.

DESCRIPTION OF THE PREFERRED EMBODIMENT

Figures 1, 2:
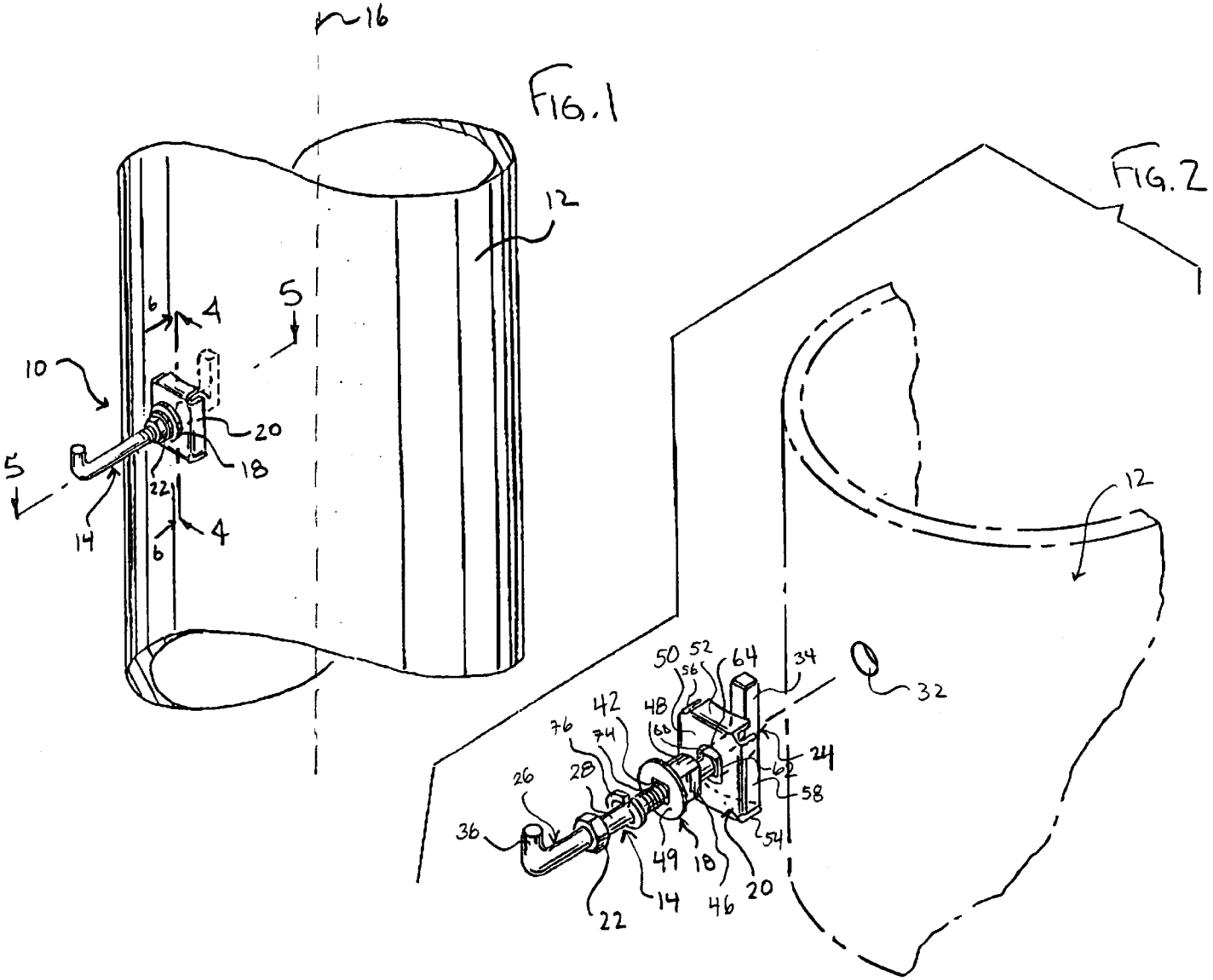
FIG. 1 is a perspective view of a step assembly for hollow poles and the like in accordance with the present invention attached to a hollow pole.
FIG. 2 is perspective view of the step assembly of FIG. 1 prior to attachment to a hollow pole (partially illustrated in phantom)

Referring to FIGS. 1 and 2, the present invention is illustrated embodied in a step assembly 10 for attachment to a hollow pole 12. The step assembly 10 is designed to readily attach a step 14 to extend radially from the pole 12 in a direction generally perpendicular to the longitudinal center axis 16 of the pole 12. It is also important to note that there are instances where the step assembly 10 may need to be removed, such as at the lower end of the pole to prevent unauthorized climbing of the pole. Thus, the design of step assembly 10 also facilitates removal from the pole 12.

The step 14 supports a climber's foot to enable climbing of the pole 12. The step assembly 10 includes a lock bushing 18 that cooperates with a mounting base 20 to attach the step 14 to the pole 12 in a manner that maintains the step 14 in a preferred rotational orientation to maximize the support capability of the step 14 and to aid in preventing unintentional loosening and detachment from the pole 12. The step assembly 10 also includes a clamping feature, as by way of a nut 22 and its threaded engagement with the step 14, to clamp the lock bushing 18, mounting base 20 and step 14 to the pole 12. The clamping feature prevents radial movement of the components of the step assembly 10 relative to the pole 12. The preferred step assembly 10 also sufficiently captivates all of the components along the step 14 so that it is a self-contained assembly which facilitates effective and efficient installation of the step assemblies 10 as one climbs the pole 10.

Referring to FIGS. 2 and 4–6, the step 14 has an elongated structure that includes a first end portion 24 used in the attachment to the pole 12, a second end portion 26 opposite the first end portion 24 and an intermediate portion 28 between the end portions 24 and 26. The intermediate portion 28 is designed to extend radially from the pole 12 to support a climber. The intermediate portion 28 preferably has a circular cross-section, even though other cross-sections, such as square, are contemplated as well. The preferred length of the intermediate portion 28 accommodates a normal range of foot widths. For example, the length of the intermediate portion may be in a range of about five to six inches.

The first end portion 24 is designed to attach the step 14 to the pole 12 in a manner that provides maximum support and prevents unintentional rotating movement. More specifically, the first end portion 24 includes at least one outer flat 30 that engages the lock bushing 18 to prevent relative rotational movement between the step 14 and the lock bushing 18. The preferred first end portion 24 has a square cross-section with four flats 30*a*–30*d*. Moreover, the first end portion 24 may have a larger cross-section dimension then the rest of the step 12. To further enhance the support capability of the step and to aid in limiting the potential for the components of the step assembly from sliding off the step 14 at the first end portion 24.

The first end portion 24 is capable of extending through a hole 32 in the pole 12 to dispose a portion of it inside the pole 12. That is, the first end portion 24 includes an arm 34 that is to be disposed in the pole 12 to engage the inner wall 77 of the pole 12 adjacent the hole 32 to support the step 14 in a cantilever fashion. The first end portion 24 is preferably bent to displace the arm 34 generally 90 degrees to the remainder of the first end portion 24. The preferred installation orients the arm 34 to extend generally vertical along with the pole 12, i.e., pointed upward and generally parallel with the longitudinal axis 16 of the pole 12. This orientation maximizes the support capability provided by the step 14. The arm 34 also aids in limiting the potential for the components of the step assembly 10 from sliding off the step 14 at the first end portion 24.

The length of the arm 34 is coordinated with the overall length of the step and the desired support capability. That is, a longer arm supports a longer step and will provide a greater support capability. For example, the preferred arm may be approximately 2.50 inches to support approximately 750 lbs. down force (measured at the end of the step) on a step reaching about eight inches from the pole.

The hole 32 in the pole 12 is coordinated with the length of the arm 34 and the cross-section dimension of the first end portion 24 to ensure that it can receive the first end portion 24 for proper installation. For example, a hole of about 15/16" diameter is able to receive an arm with an approximate length of 2.5 inches and square cross-section of about 0.750 inches. Thus, the hole 32 must be large enough in dimension to be able to receive the first end portion 24 of the step 14.

The second end portion 26 is designed to aid in sufficiently captivating the components of the step assembly 10 along that step 14 for effective and efficient installation. More specifically, the second end portion 26 includes a stop 36 that prevents the components from sliding off the end of the of the step 14 at the second end portion 26. Thus, the arm 34 of the first end portion 24 and the stop 36 of the second end portion 26 benefits the installation process of the step assembly 10 by sufficiently captivating all of the components on the step 14.

The stop 36, which is preferably in the form of a short arm-like structure, is formed by bending the second end portion 26 to dispose the stop portion at an angle generally 90 degrees to the remainder of the second end portion 26. The position of the bend is coordinated with the desired length of the stop and is preferably spaced inward from the end of the step 14 at the second end portion 26 to provide the stop with sufficient length to prevent the components (namely the nut which, in turn, stops the other components) of the step assembly from sliding off the step 14. For example, the preferred length of the stop is formed from a bend positioned about 1.5 inches inward from the end for a step having a circular cross-section of about 0.625 inches in diameter at the second end portion, To assemble the step assembly, the stop 36 is formed after the components are slid onto the step 14. This stop design also aids in preventing the climber's foot from sliding off the step 12 at the second end portion 26. For example, the preferred installation would orient the stop 36 in the vertical direction, i.e., generally parallel with the longitudinal axis 16 of the pole 12.

Figure 7:
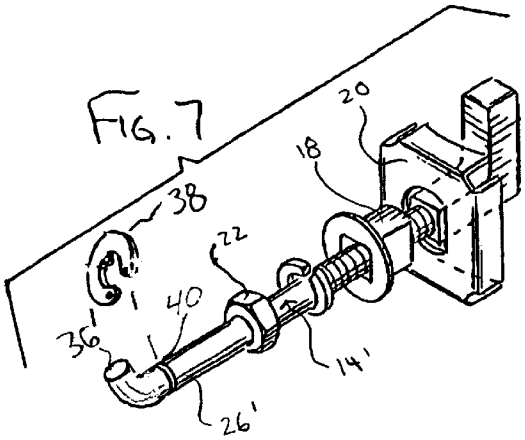
FIG. 7 is a partial perspective view of another embodiment of a step used with the step assembly of FIG. 1.
Figure 6:
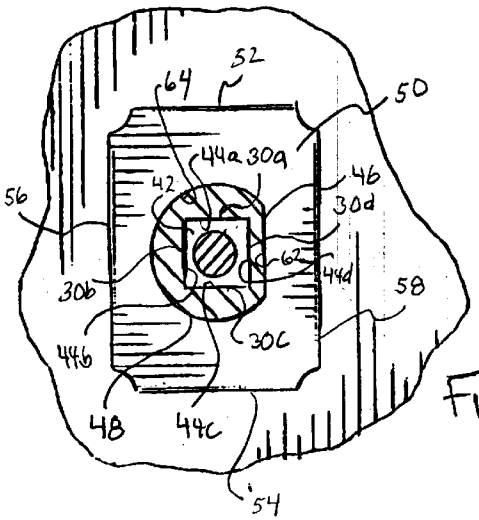
FIG. 6 is a front cross-sectional view of the step assembly of FIG. 1, taken along line 6—6 of FIG. 1.

Alternatively, other stop designs can be employed to achieve the desired result of sufficiently captivating the components of the step assembly along the step. For example, a clip, such as the "C"-shaped clip 38 illustrated in FIG. 7, can be affixed to the step 14' adjacent its end at the second end portion 26' when the stop 36' is of insufficient size and bend radius to prevent the nut 22 and other components from falling off the step. More specifically, once the components of the step assembly are slid onto the step 14' past the stop 36' and second end portion 26', the clip 38 is snapped onto the second end portion 26' at a circumferential groove 40 about the step 14'. The clip 38 is sufficiently large to prevent the nut 22 from sliding off the end of the step 14'. The added benefit of this embodiment of the invention is that it facilitates hardening of the step after the stop 36' has been bent (e.g., hardening processes may prohibit non-destructive bending thereafter) while also allowing the assembling of the rest of the components upon the step after hardening. Another alternate design may include the second end portion being threaded to mesh with a nut. The nut is turned on the second end portion after the components are placed on the step. Further, the end at the second end portion may be enlarged by conventional machining techniques after the components are slid onto the shaft.

The lock bushing 18 is designed to engage and interconnect the step 14 and the mounting base 20 to prevent relative rotational movement between such components. More specifically, the lock bushing 18 includes a longitudinal passage 42 designed to receive the first end portion 24 of the step 14 with a locking engagement. The passage 42 is defined by at least one inner flat surface 44 to mate with the flat 30 of the first end portion 24. The cross-section dimensions of the passage are coordinated with that of the first end portion 24 of the step 14 so that the passage 42 receives the first end portion 24 with a close fit that minimizes wobble and prevents the step 14 from rotating relative to the lock bushing 18 about its longitudinal axis.

The preferred passage has a square cross-section defined by four inner flat surfaces 44*a*–44*d* that complement, respectively, the four flats 30*a*–30*d* of the first end portion 24. Thus, the lock bushing 18 is able to slide along the intermediate portion 28 of the step 14 and over the first end portion 24 when the flat surfaces 44*a*–44*d* are aligned with the flats 30*a*–30*d*. Because the engagement between the flats 30 and surfaces 44 prevents relative movement of the two parts, the clearance between such should be only that necessary to allow the lock bushing 18 to slide easily on the first end portion 24 of the step 14; however, the clearance should minimize wobble or play between the components. For example, the square cross-section of the passage may be about 0.760 inches for a square cross-section of about 0.750 at the first end portion. Thus, the preferred clearance is about 0.01 inches.

The lock bushing 18 includes an exterior configuration designed to engage the mounting base 20 to prevent relative rotational movement between such components. More specifically, the exterior configuration includes a flat 46 and an arcuate surface 48 extending between the longitudinal edges of the flat 46. At one end, the lock bushing 18 includes an enlarged flange 49 that engages the mounting base 20 to limit longitudinal movement of the lock bushing 18 along the step 14 and to aid in clamping the lock bushing 18 with the nut 22.

The mounting base 20 is designed to spread the load of a climber on the step 14 to areas spaced from the hole 32 of the pole 12. The mounting base 20 also prevents unintentional detachment, such as when a force is applied from underneath of or sideways on the step 14, and rotational movement with respect to the pole 12. More specifically, the mounting base 20 includes a main panel 50 that spaces four side panels, which comprise a top panel 52, a bottom panel 54, a left panel 56 and a right panel 58, extending from the main panel 50. The preferred mounting base spaces the top and bottom panels farther apart than the left and right panels because the loading on the step is greater in the vertical direction.

The main panel 50 also defines an aperture 60 that is generally positioned in the center of the main panel 50 to cooperate with the outer flat 46 of the lock bushing 18 to prevent relative rotational movement between such components. More specifically, the aperture 60 is defined by an inner edge designed to engage the exterior of the lock bushing 18. The preferred inner edge has a straight portion 62 that complements and engages the outer flat 46 of the lock bushing 18 and an arcuate portion 64 that complements and engages the outer arcuate surface 48 of the lock bushing 18. As with the engagement between the lock bushing 18 and the first end portion 24 of the shaft 14, the clearance between the engaging edges of the mounting plate 20 and surfaces of the lock bushing 18 should be as small as possible so to enable easy insertion into the aperture 60 but to minimize wobble or play between such components. For example, the clearance may be about 0.010±0.005 inches.

Figure 5:
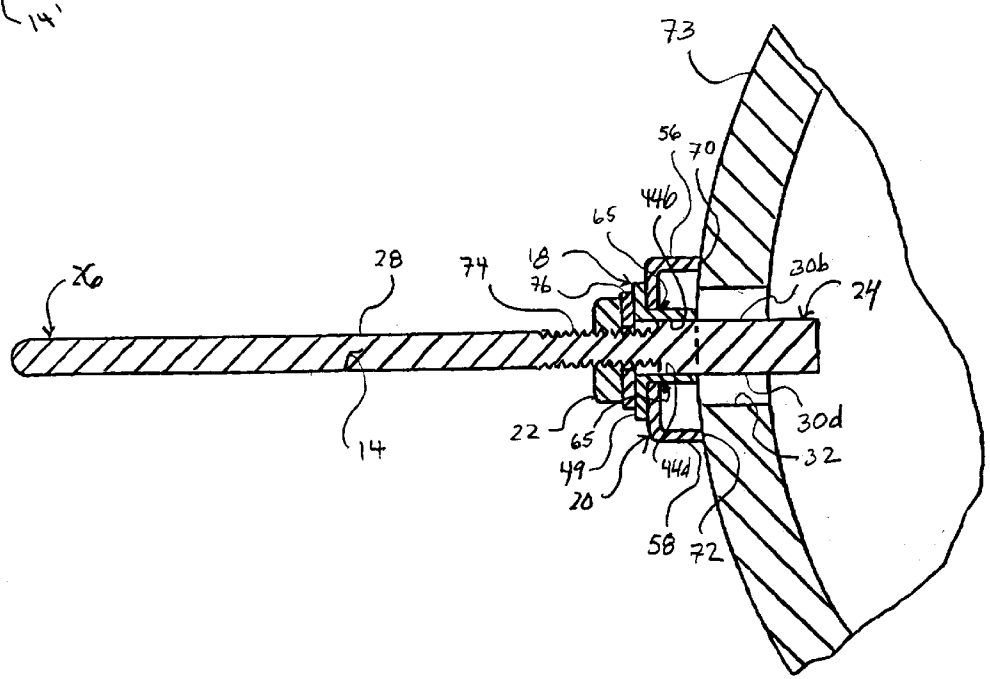
FIG. 5 is a top cross-sectional view of the step assembly of FIG. 1, taken along line 5—5 of FIG. 1.

As previously discussed) the lock bushing 18 and mounting base 20 are separate components. As an alternative, these components may be permanently affixed to another to further facilitate effective installation. For example, a tack weld 65 may be placed to the left and right of the lock bushing 18 after it has been inserted into the aperture 60 of the mounting base 20, as shown in FIG. 5. This prevents the lock bushing 18 from separating from the mounting base 20 and aids in installation.

The side panels 52, 54, 56 and 58 of the mounting base 20 extend generally perpendicular to the main panel 50, and each includes a terminal edge 66, 68, 70 and 72, respectively, that is designed to engage the pole 12. The top and bottom edges 66 and 68 are arcuate to complement the arcuate contour of the outer surface 73 of the pole 12 to prevent relative rotational movement between the mounting base 20 and the pole 12. For example, the top and bottom edges may have a radius of curvature of about 4.9 inches. Further, the top and bottom edges 66 and 68 are designed to engage the pole 12 perpendicular to the pole's longitudinal axis 16. This engagement prevents the mounting base 20 from rotational movement relative to the pole 12, which, by way of the lock bushing 18, prevents the step 14 from rotating along its longitudinal axis relative to the pole 12. This ensures that the arm 34 of the first end portion 24 of the step 14 remains generally vertical, i.e., generally parallel to the longitudinal axis 16 of the pole 12, to provide maximum support for the cantilevered step 14 and to aid in preventing unintentional loosening and detachment of the step 14 from the pole 12.

The nut 22 clamps the step 14, the lock bushing 18 and the mounting base 20 to the pole 12. More specifically, the intermediate portion 28 of the step 14 preferably includes threads 74 adjacent to the transition with the first end portion 24. As the nut 22 is turned on the threads 74 toward the first end portion 24, the lock bushing 18 and the mounting base 20 are pushed toward the pole 12 and the arm 34 of the first end portion 24 is pulled toward the pole 12. Thus, the lock bushing 18, the mounting plate 20 and the wall of the pole 12 are clamped between the nut 22 and the arm 34 of the first end portion 24 of the step 12. A typical pole is made of fiberglass with a diameter in the range of 12 to 20 inches and ⅜ inch wall thickness or steel with a 10 inch diameter and 7 gage wall thickness. Further, the nut 22 is preferably a hex jam nut because its thinner profile helps to maximize the amount of foot space of the intermediate portion 28 of the step 14. To further ensure that the nut 22 does not unintentionally loosen, a lock washer 76 is preferably disposed between the nut 22 and the flange 49 of the lock bushing 18. The preferred lock washer is a helical spring lock washer.

Figure 3:
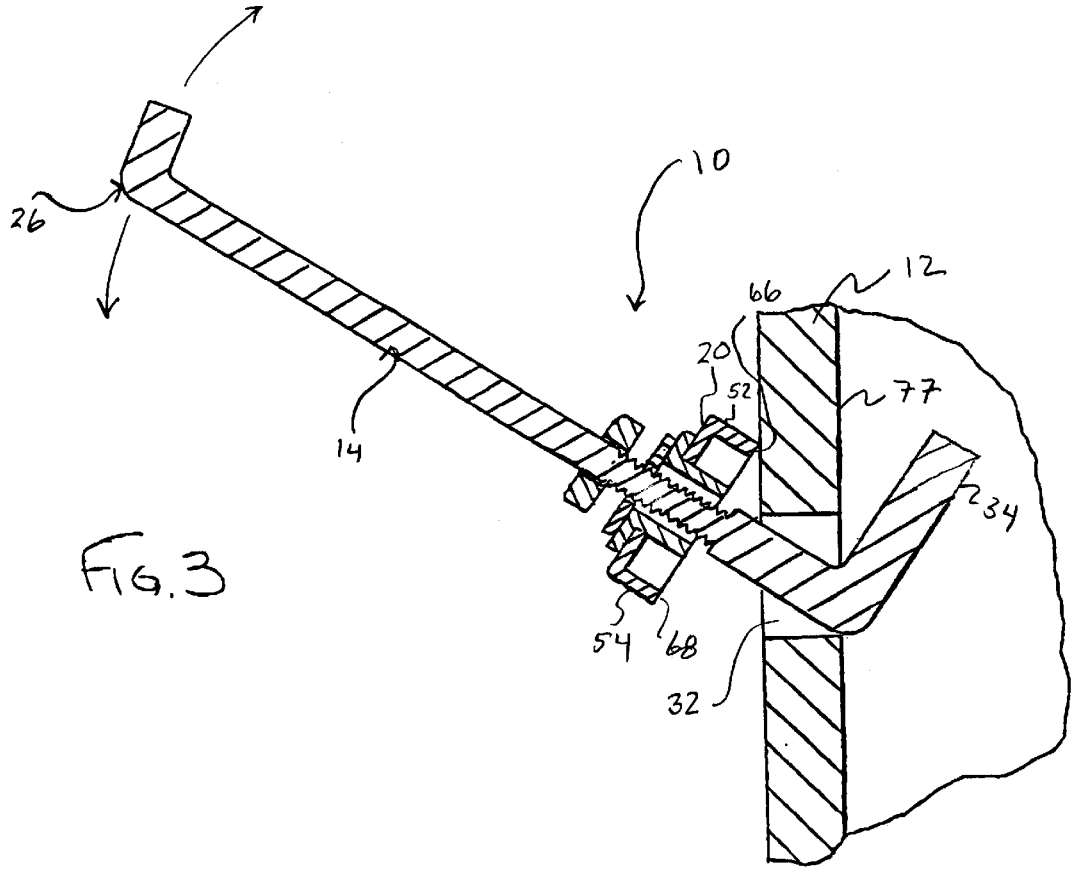
FIG. 3 is a side cross-sectional view of the step assembly of FIG. 1 being installed to a hollow pole.
Figure 4:
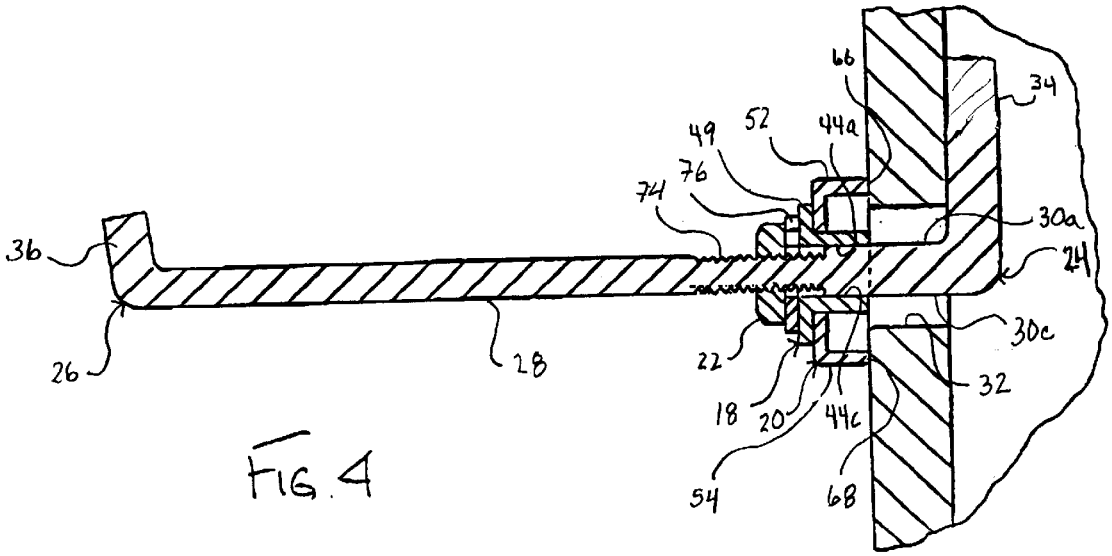
FIG. 4 is a side cross-sectional view of the step assembly of FIG. 1, taken along line 4—4 FIG. 1.

With reference to FIGS. 3 and 4, the step assembly 10 is attached to the pole 12 by first tilting the second end portion 26 of the step 14 upward to align the arm 34 of the first end portion 24 with the hole 32 through the pole 12. As the arm 34 is inserted through the hole 32, the step assembly 10 is tilted downward until the entire arm 34 is disposed in the pole 12. The step 14 is then rotated to orient the arm 34 to extend upward (i.e., generally parallel with the longitudinal axis 16 of the pole 12), and pulled to engage the arm 34 with the inner surface of the pole 12.

After the step 14 is properly oriented and positioned, the mounting base 20 is rotated about the step 14 so that the top and bottom edge 66 and 68 of their respective panels 52 and 54 will engage the outer surface 73 of the pole 12 generally perpendicular to longitudinal axis 16 of the pole 12 and, then, is slid along the step 14 into engagement with the pole 12. In this position, the straight edge portion 62 of the aperture 60 of the mounting plate 20 is generally parallel with the longitudinal axis 16 of the pole 12.

At the same time the lock bushing 18, is then rotated about the step 14 to orient the inner flat surfaces 44 of the lock bushing 18 with the outer flats 30 of the first end portion 24 of the step 12, thereby engaging the step. This step is eliminated when the lock bushing 18 and mounting base 12 are attached by the tack welds 65.

Finally, the nut 22 is turned upon the threads 74 of the intermediate portion 28 of the step 14 to push the lock washer 76 flush against the flange 49 of the lock bushing 18. As the nut 22 is tightened further, the lock bushing 18 and the mounting base 20 are pushed tightly toward the pole 12 and the arm 34 of the first end portion 24 of the step 12 is pulled tightly toward the pole 12. Thus, the nut 22, the threads 74 of the step 14 and arm 34 clamp together to maintain the proper orientation of the step 14 and aid in preventing its unintentional loosening and detachment.

While the invention has been described in the specification and illustrated in the drawings with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is not intended that the invention be limited to the particular embodiments illustrated by the drawings and described in the specification as the best modes presently contemplated for carrying out this invention, but that the invention will include any embodiments falling within the description of the appended claims.

What is claimed is:

1. A step assembly that is capable of securing to a hollow pole adapted with at least one hole, the assembly comprising:

an elongated step having a first end portion and a second end portion opposite the first end portion, the first end portion having an arm and at least one flat and being capable of extending through a hole to position the arm inside a hollow pole;

a bushing on the step and defining an interior hole with at least one interior flat for engaging the flat of the first end portion to prevent relative rotational movement between the step and the bushing and at least one exterior flat;

a base on the step and having a surface for engaging the hollow pole to prevent relative rotational movement between the hollow pole and the base and an edge defining a hole for receiving the bushing and for engaging the exterior flat of the bushing to prevent relative rotational movement between the bushing and the base; and a clamp along the step that includes surfaces to engage the elongated step at various predetermined positions to prevent longitudinal movement of the bushing and base along the step.

2. The step assembly of claim 1 wherein the second end portion includes a stop and the arm of the first end portion and the stop of the second end portion are of sufficient size to sufficiently captivate the bushing, the base and clamp on the step to facilitate securing of the step assembly to the hollow pole.

3. The step assembly of claim 2 wherein the base includes at least one sidewall, the surface engaging the hollow pole is on the sidewall and the sidewall spaces the edge defining the hole of the base from the hollow pole.

4. The step assembly of claim 3 wherein the surface engaging the hollow pole has an arcuate profile to complement an arcuate exterior profile of the hollow pole.

5. The step assembly of claim 4 wherein the first end portion of the step has at least four flats and the interior hole of the bushing is defined, at least in part, by at least four flats wherein the four flats of the step engage the four flats of the bushing to prevent relative rotational movement between the step and the bushing.

6. The step assembly of claim 5 wherein the first end portion of the step has a square cross-section forming the at least four flats of the step and the interior hole of the bushing has a complementary square cross-section defined by the at least four flats of the bushing.

7. The step assembly of claim 5 wherein at least some portion of the first end portion of the step has a larger transverse cross-section than that for the remainder of the step.

8. The step assembly of claim 5 wherein the bushing and base encircle the elongated step.

9. The step assembly of claim 8 wherein the clamp includes threads on the elongated step and a nut that meshes with the threads.

10. The step assembly of claim 8 wherein the bushing and base are permanently affixed to one another.

11. The step assembly of claim 8 wherein the bushing and base are formed to constitute a single component.

* * * * *